US007891404B2

(12) United States Patent
Hansen

(10) Patent No.: US 7,891,404 B2
(45) Date of Patent: Feb. 22, 2011

(54) MACHINE FOR PRODUCING FLASKLESS MOLDS

(75) Inventor: Torben Hansen, Copenhagen S (DK)

(73) Assignee: DISA Industries A/S, Herlev (DK)

( * ) Notice: Subject to any disclaimer, the term of this patent is extended or adjusted under 35 U.S.C. 154(b) by 0 days.

(21) Appl. No.: 12/445,488

(22) PCT Filed: Jun. 25, 2007

(86) PCT No.: PCT/IB2007/001707

§ 371 (c)(1),
(2), (4) Date: Nov. 11, 2009

(87) PCT Pub. No.: WO2009/001150

PCT Pub. Date: Dec. 31, 2008

(65) Prior Publication Data

US 2010/0096100 A1 Apr. 22, 2010

(51) Int. Cl.
*B22C 11/00* (2006.01)

(52) U.S. Cl. ..... 164/211; 164/169

(58) Field of Classification Search ..... 164/211, 164/169

See application file for complete search history.

(56) References Cited

U.S. PATENT DOCUMENTS 6,499,531 B1 12/2002 Knudsen

*Primary Examiner*—Kevin P Kerns
*Assistant Examiner*—Erin B Saad
(74) *Attorney, Agent, or Firm*—Stites & Harbison PLLC; Douglas E. Jackson

(57) ABSTRACT

The present invention relates to a moulding machine (1) for producing flaskless moulds. The moulding machine (1) comprises a drag flask (3) and a cope flask (2), a drag squeeze plate (6) associated with said drag flask (3), and a cope squeeze plate (5) inserted in said cope flask (2), all arranged to be rotated between a horizontal and a vertical position and the drag flask (3) and cope flask (2) being arranged to be movable relative towards one another and away from one another. The drag flask (3), the cope flask (2), the drag squeeze plate (6), and the cope squeeze plate (5) are guided in their relative movement by a common set of guide rods (7), whereby the alignment procedure for these components is significantly facilitated.

9 Claims, 12 Drawing Sheets

MACHINE FOR PRODUCING FLASKLESS MOLDS

TECHNICAL FIELD

The present invention relates to a machine for producing flaskless moulds of the kind set forth in the preamble of claim 1.

BACKGROUND ART

Document EP 1,161,319 discloses a mould-forming machine of the above-mentioned type. This moulding machine is of a type in which a cope flask, a pattern plate and a drag flask are capable of rotating over an angle of 90° between a horizontal position and a vertical position. The horizontal position is associated with inserting the pattern plate between the cope and drag flask before the sand charging and compacting step and is associated with the removing of the pattern plate and the discharging of the cope and drag after the charging and compacting step. The sand charging and compacting step is performed with the cope flask, drag flask and pattern plate in the vertical position. The cope flask with the cope flask squeeze plate and the drag flask with the drag flask squeeze plate are supported by a swing frame and rotatable in unison between the horizontal position and the vertical position, and the relative movements of the cope squeeze plate, drag flask and drag squeeze plate are guided by separate guide rods, respectively, whereas the cope flask is held fixedly relative to the swing frame. In this way the alignment function is provided by the swing frame and the guide rods connected thereto, and a separate compression frame is used to transmit the relative large forces related to the compacting of the sand.

This construction is relatively complex and the alignment of the individual guide rods for each of the movable components, i.e. drag flask, cope squeeze plate, drag squeeze plate and pattern plate, requires a time-consuming procedure during assembly of the machine.

DISCLOSURE OF THE INVENTION

Based on this prior art it is the object of the invention to provide a moulding machine of the kind referred to above, with which the complexity is reduced and the alignment procedure is restricted to alignment of only one set of guide rods, said set of rods preferably consisting of two such rods, and these objects are achieved with a moulding machine of said kind, which according to the present invention also comprises the features set forth in the characterizing clause of claim 1. With this arrangement the complexity and the aligning procedure for the guide rods is simplified and furthermore, the moulding machine can be made relatively compact, requiring only limited space in the production facility.

Further advantageous features, the advantages of which will be evident from the following description, are revealed in the sub-ordinate claims.

BRIEF DESCRIPTION OF THE DRAWINGS

In the following detailed part of the present description, the invention will be explained in more detail with reference to the exemplary embodiments of the moulding machine for producing flaskless moulds according to the invention shown in the drawings, in which.

DESCRIPTION OF THE PREFERRED EMBODIMENT

Figure 2:
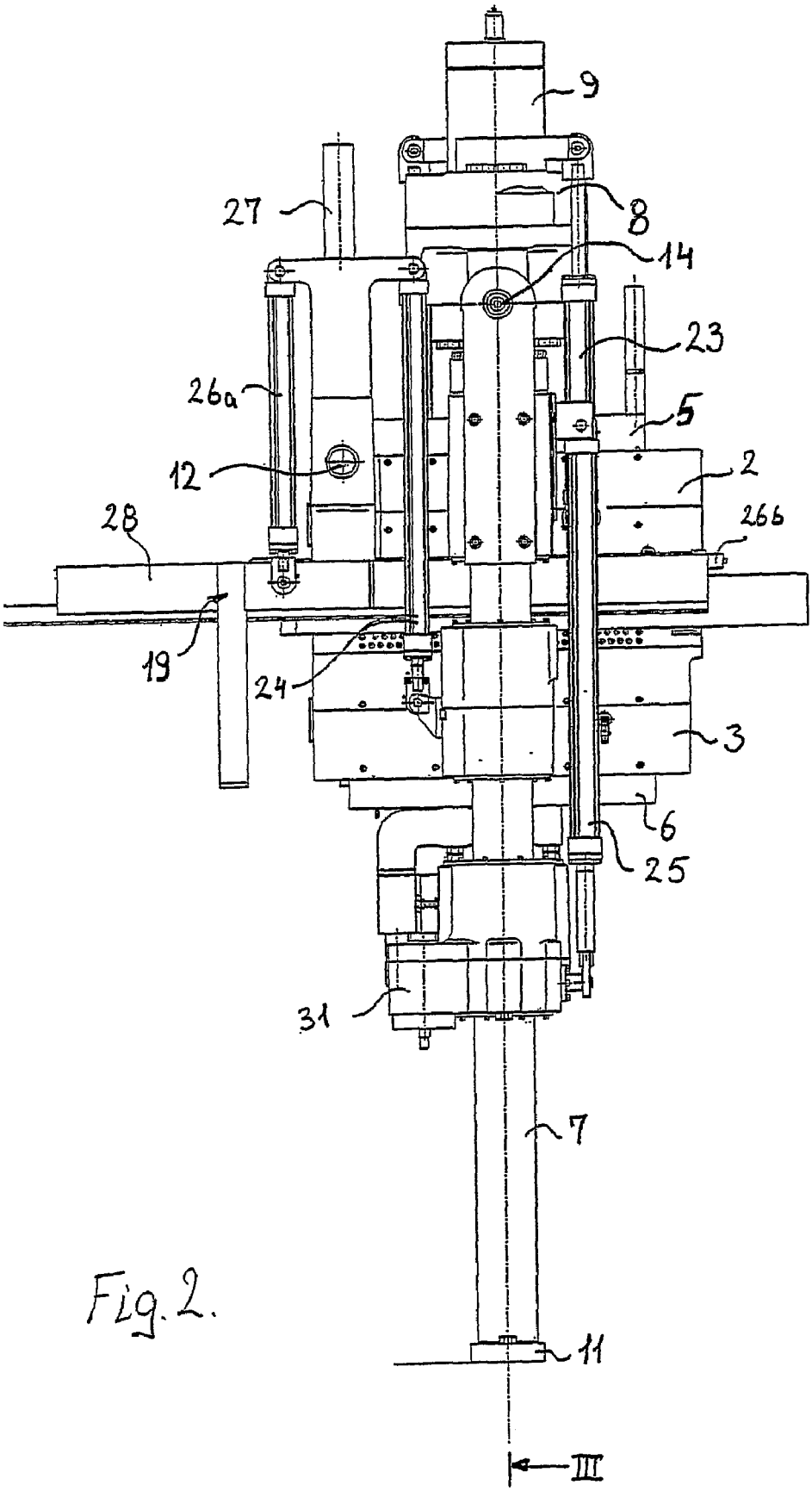
FIG. 2 shows the same part of the machine seen from the side.
Figure 3:
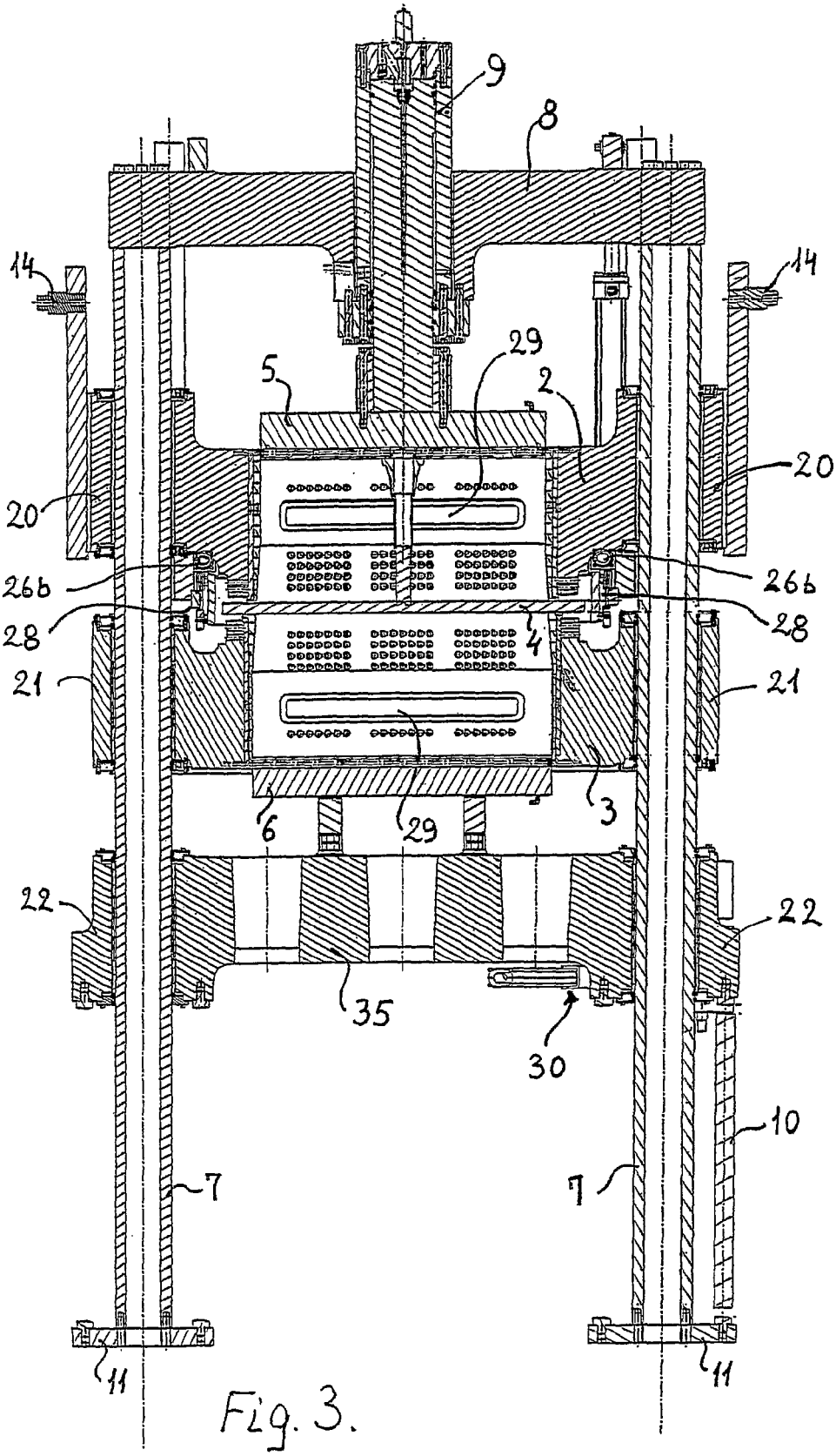
FIG. 3 shows a cross section along the lines III-III in FIG. 2.
Figure 4:
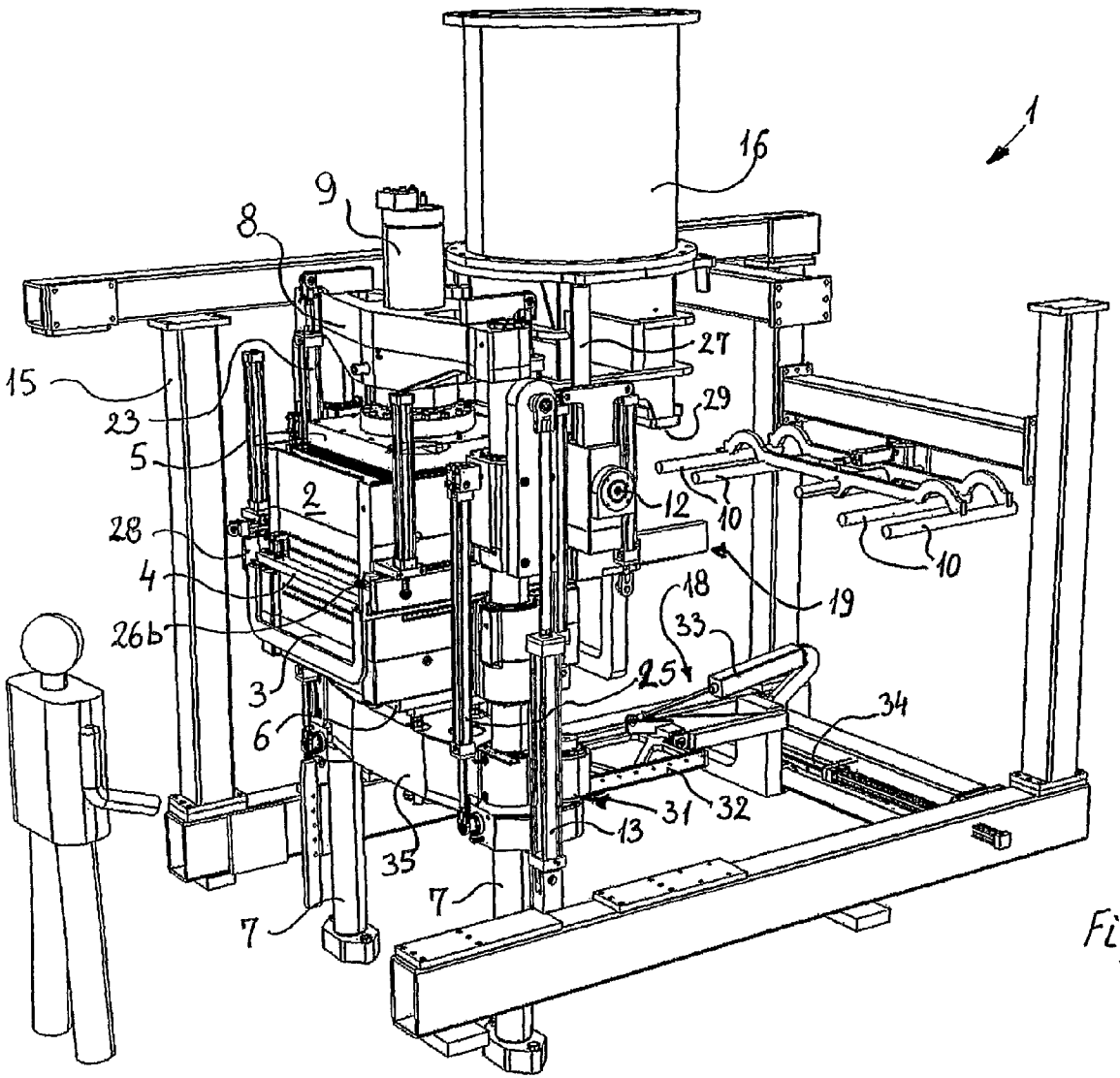
FIG. 4 shows a perspective view of a preferred embodiment of the moulding machine in a position ready for rotation, with the pattern plate positioned between the cope flask and the drag flask and the cope squeeze plate and drag squeeze plate in a position to define the mould-forming chambers, all positioned in the horizontal position.

The machine for producing flaskless moulds shown in FIG. 4 is provided with a base frame 15 which carries the other components of the machine. The machine comprises a rotatable part shown in FIGS. 1-3, rotatably mounted to the base frame 15 through bearings 12 associated with the cope flask 2. In the FIGS. 4-12 part of the frame 15 is cut away in order to be able to see the essential parts of the machine. A piston cylinder unit 13 is connected between the frame 15 and a connection point 14 associated with the cope flask 2, the connection point 14 for the piston cylinder unit 13 being positioned at a suitable distance from the bearing 12 for providing the rotational movement.

As best shown in FIG. 3, the cope flask 2 is provided with linear bearings 20 for the guide rods 7, thus rotating with the rotation of the cope flask 2. At the upper end of the guide rods 7, a yoke 8 is connected between the upper ends of the two guide rods 7, said yoke 8 supporting a pressure cylinder 9, the piston rod of which is connected to the cope squeeze plate 5 for compacting the sand moulds.

A drag flask 3 is disposed below the cope flask 2 and connected to the guide rods 7 by means of linear bearings 21 to allow a linear movement along these guide rods 7. Furthermore, the drag squeeze plate 6 is connected to a yoke 35 with a set of linear bearings 22 for linear movement along the guide rods 7.

Figure 1:
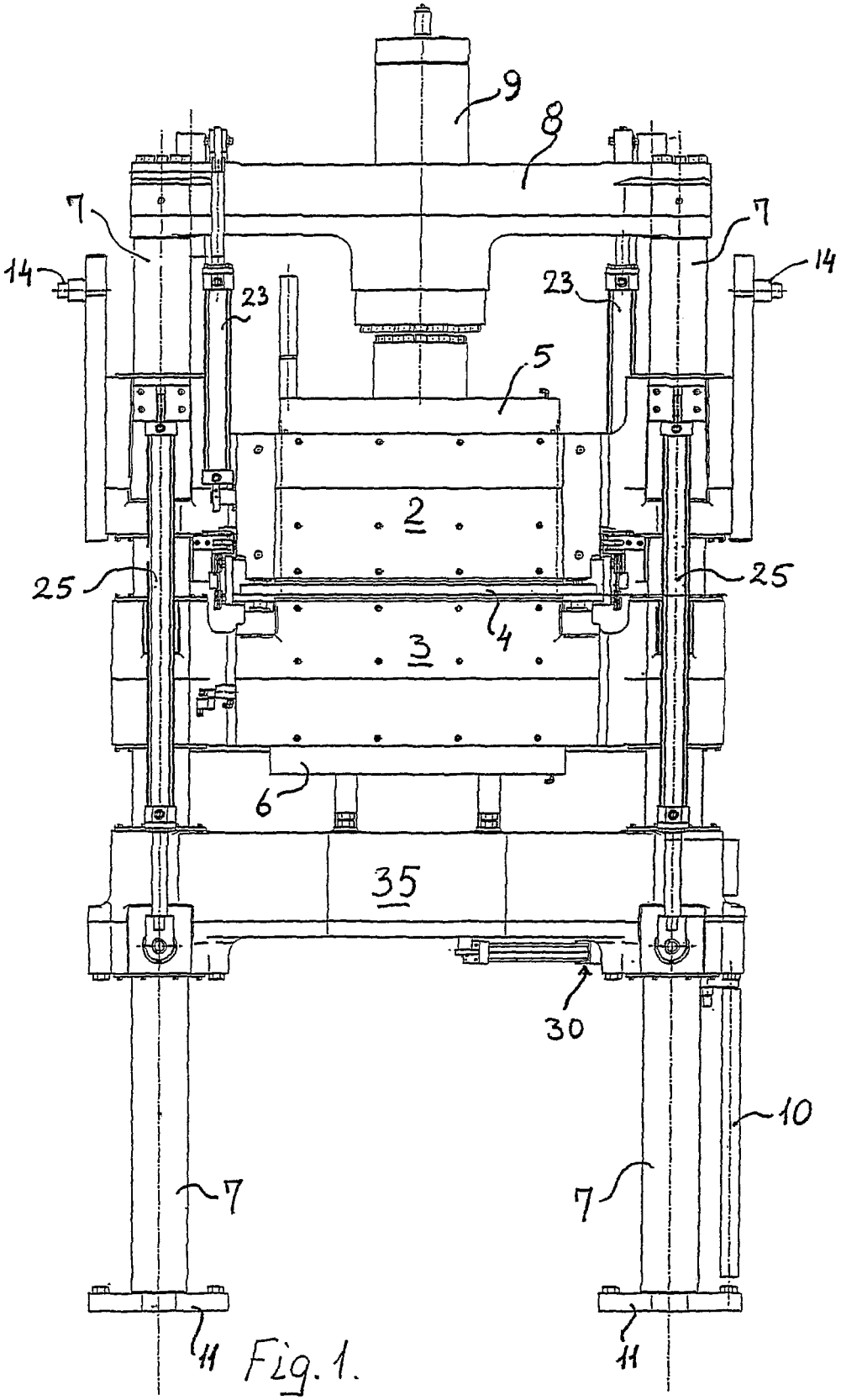
FIG. 1 shows a preferred embodiment of the rotatable part of the moulding machine in accordance with the present invention.
Figure 5:
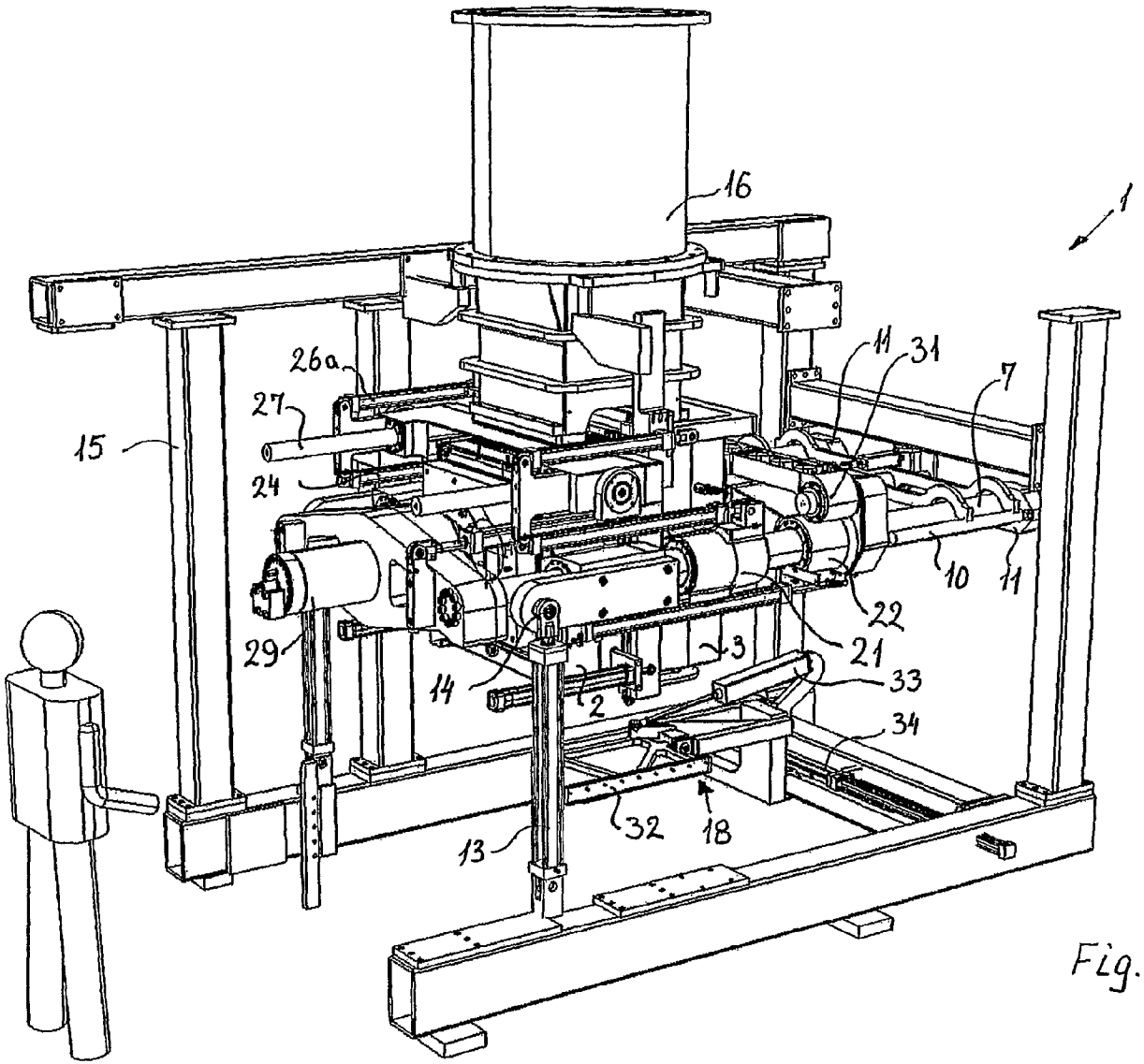
FIG. 5 shows the moulding machine with the rotatable part rotated to the vertical position ready for sand charging.

When the rotatable system is in the vertical position, as shown in FIG. 5, a set of stays 10, only one shown in FIGS. 1 and 3, are positioned as shown in FIG. 1 and FIG. 3. In this position, the compacting of the sand is provided by means of the pressure cylinder 9 moving the cope squeeze plate 5 into the cope flask 2 and the yoke 8 and the guide rods 7 in the opposite direction, whereby the stays 10 engage the yokes 11 and a corresponding engagement point on the linear bearing 22 for the drag squeeze plate 6, thus moving the drag squeeze plate 6 into the drag flask 3, hence compacting the sand inside the cope flask 2 and the drag flask 3 around the pattern plate 4 which is inserted between those two flasks.

The pattern plate 4 can be moved in and out of the interspace between the cope flask 2 and the drag flask 3 by means of a pattern-plate-moving mechanism 19 comprising rails 28 for providing horizontal movement of the pattern plate 4, said rails 28 being connected to piston cylinder units **26*b* for this movement, and said pattern-plate-moving mechanism 19 further being connected to the cope flask 2 via guide rods 27 providing the possibility of moving the pattern plate in a direction along the guide rods 7 by means of a piston cylinder unit 26*a* connected between the pattern-plate-moving mechanism 19 and the cope flask 2. The pattern-plate-moving mechanism 19 comprises suitable means for engaging and supporting the pattern plate 4 when moved in and out of the interspace between the cope flask 2 and the drag flask 3, and for disengaging the pattern plate 4, when held in position between the cope flask 2 and the drag flask 3**.

Figure 10:
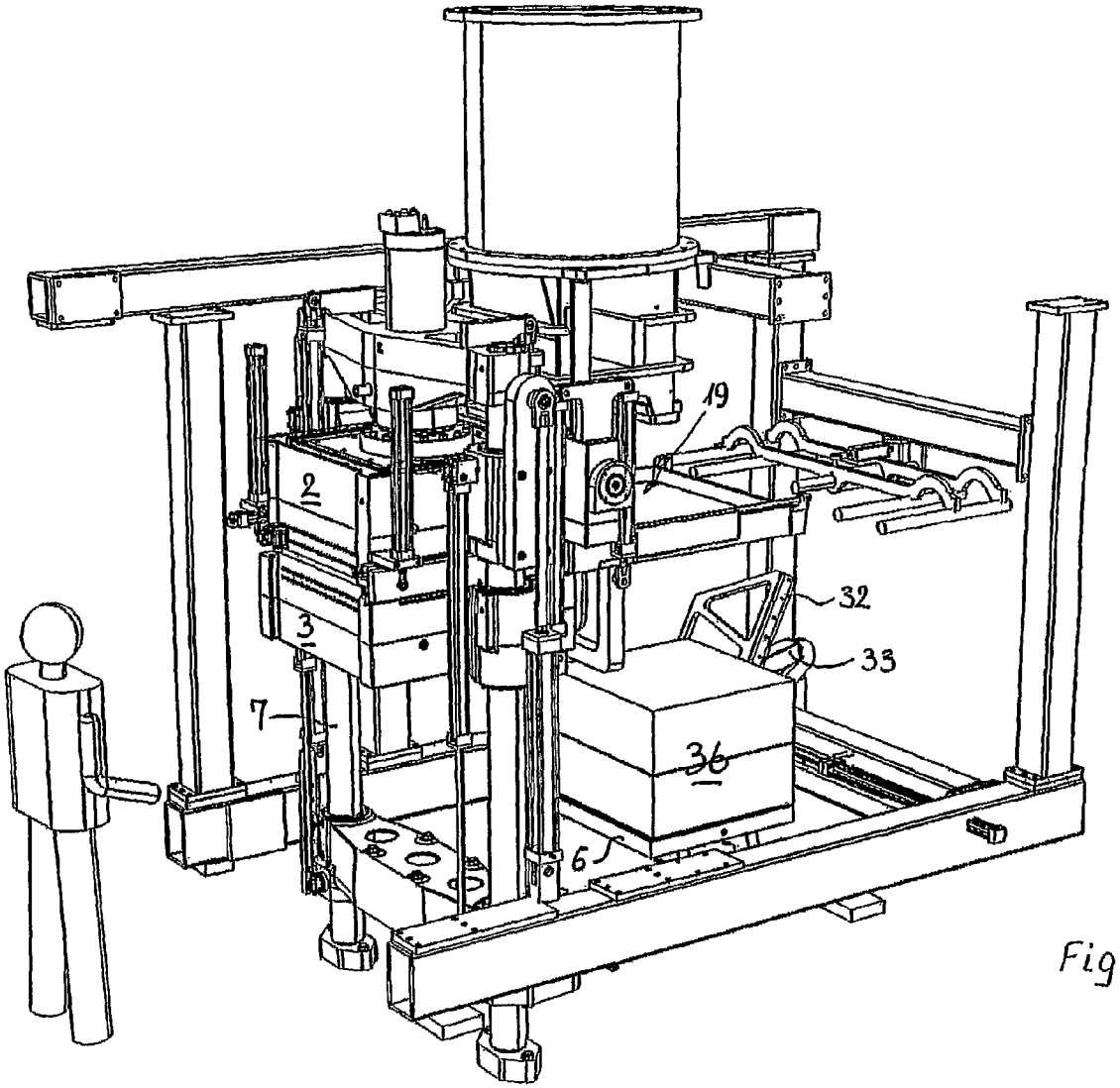
FIG. 10 shows the moulding machine in a position, in which the drag squeeze plate has been rotated about a vertical axis and with the expelling arm tilted to allow this rotation.
Figure 11:
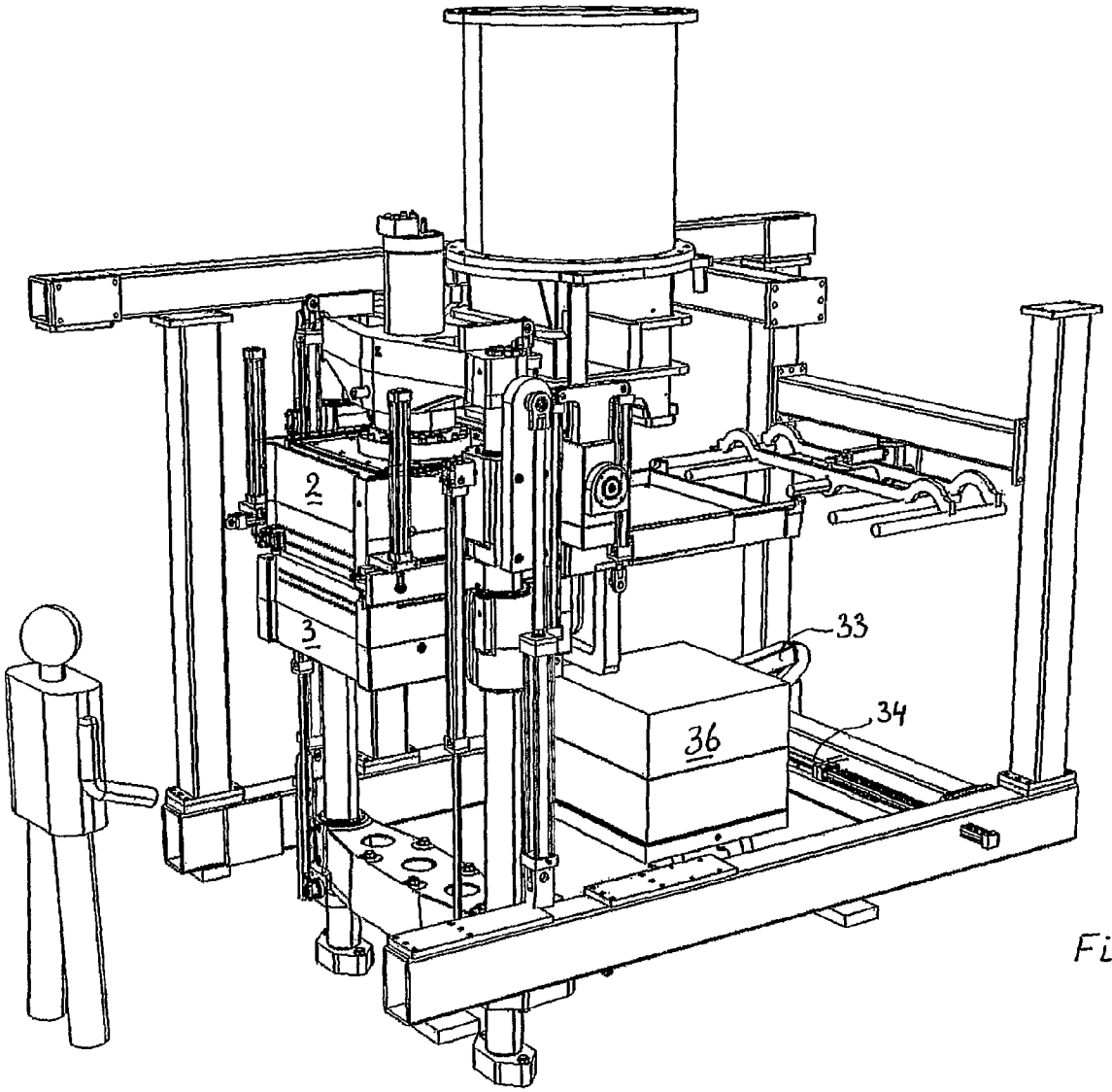
FIG. 11 shows the moulding machine with the expelling arm returned to the horizontal position ready for expelling the finished mould parts.

The drag squeeze plate 6 is connected to the linear bearings 22 for the drag squeeze plate via a pivotal mechanism pivoting on a bearing 31 as said pivotal movement being provided by means of a piston cylinder unit 30, said pivotal movement moving the drag squeeze plate 6 between the normal position for co-operating with the drag flask 3 to a position as shown in FIG. 10 and FIG. 11 for discharging the produced flaskless moulds sideways out of the moulding machine 1. The discharge of the produced flaskless mould is provided by means of an expelling mechanism 18 comprising an expelling arm 32 being pivotal between a horizontal and a vertical position by means of a piston cylinder unit 33 and movable between a position inside the moulding machine 1 to a position outside the moulding machine 1 by means of a piston cylinder unit 34.

The correct positioning of the cope squeeze plate 5 relative to the cope flask 2 is provided by means of a piston cylinder unit 23 connected between the cope flask 2 and the yoke 8, thus positioning the cope squeeze plate 5, the yoke 8 and the guide rods 7 relative to the cope flask. Correspondingly, a piston cylinder unit 24 is connected between the cope flask 2 and the drag flask 3 for positioning of the drag flask and a piston cylinder unit 25 is connected between the cope flask 2 and the drag squeeze plate 6 for positioning thereof.

A sand-charging system 16 is provided for charging sand into the cope flask 2 and the drag flask 3 through sand-charging openings 29 in the cope and drag flasks, said sand-charging openings 29 being connected to the sand-charging system 16 when the rotatable part of the machine is in the vertical position as shown in FIG. 5.

The production process of moulding a flaskless mould comprising two mould halves with the machine according to the invention will now be described with reference to FIGS. 4-12.

The sequence of operations starts in the state shown in FIG. 4 with the flasks in a horizontal position and with the pattern plate 4 inserted between the cope flask 2 and the drag flask 3. Furthermore, the cope squeeze plate 5 and the drag squeeze plate 6 are inserted in the cope flask 2 and the drag flask 3, respectively, thus defining the mould chambers inside the flasks. In the next step, the rotatable system is rotated over 90° from the horizontal position to the vertical position by the hydraulic cylinder 13, as shown in FIG. 5. The sand-charging system 16 is now connected to the sand-charging openings 29 of the respective flask. In the following step, still in the position as shown in FIG. 5, the mould-half-forming spaces in the cope flask 2 and the drag flask 3 are filled with sand by supplying sand from the sand-charging system 16.

Then, the charged sand is compacted by the cope squeeze plate 5 and the drag squeeze plate 6 being forced further into the cope flask 2 and the drag flask 3, respectively. This compaction is provided by means of the pressure cylinder 9, as described previously. As a result, a cope and drag are moulded by compression in the cope flask 2 and the drag flask 3.

Figure 6:
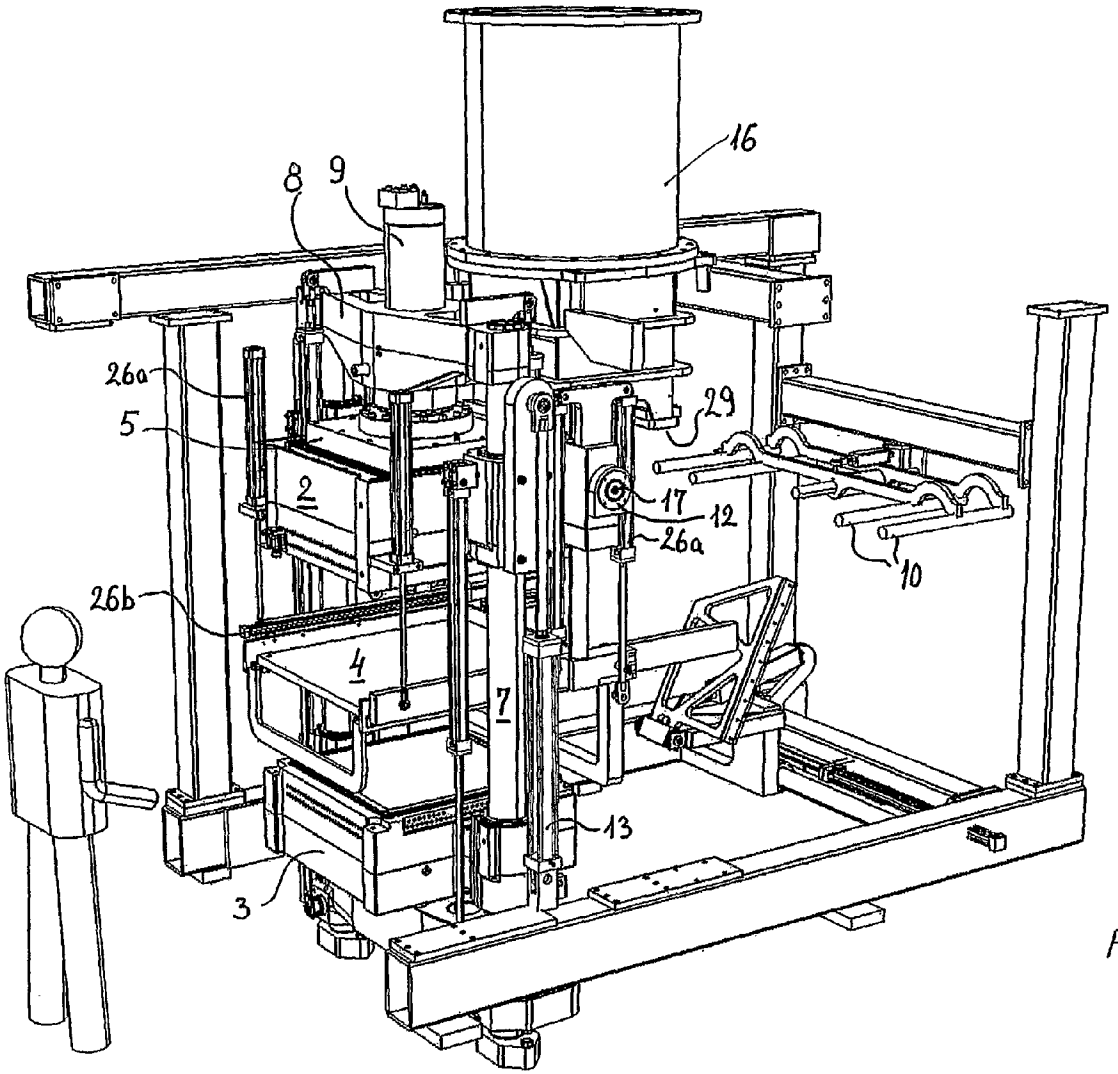
FIG. 6 shows the moulding machine returned to the horizontal position and opened in order to be able to remove the pattern plate.
Figure 7:
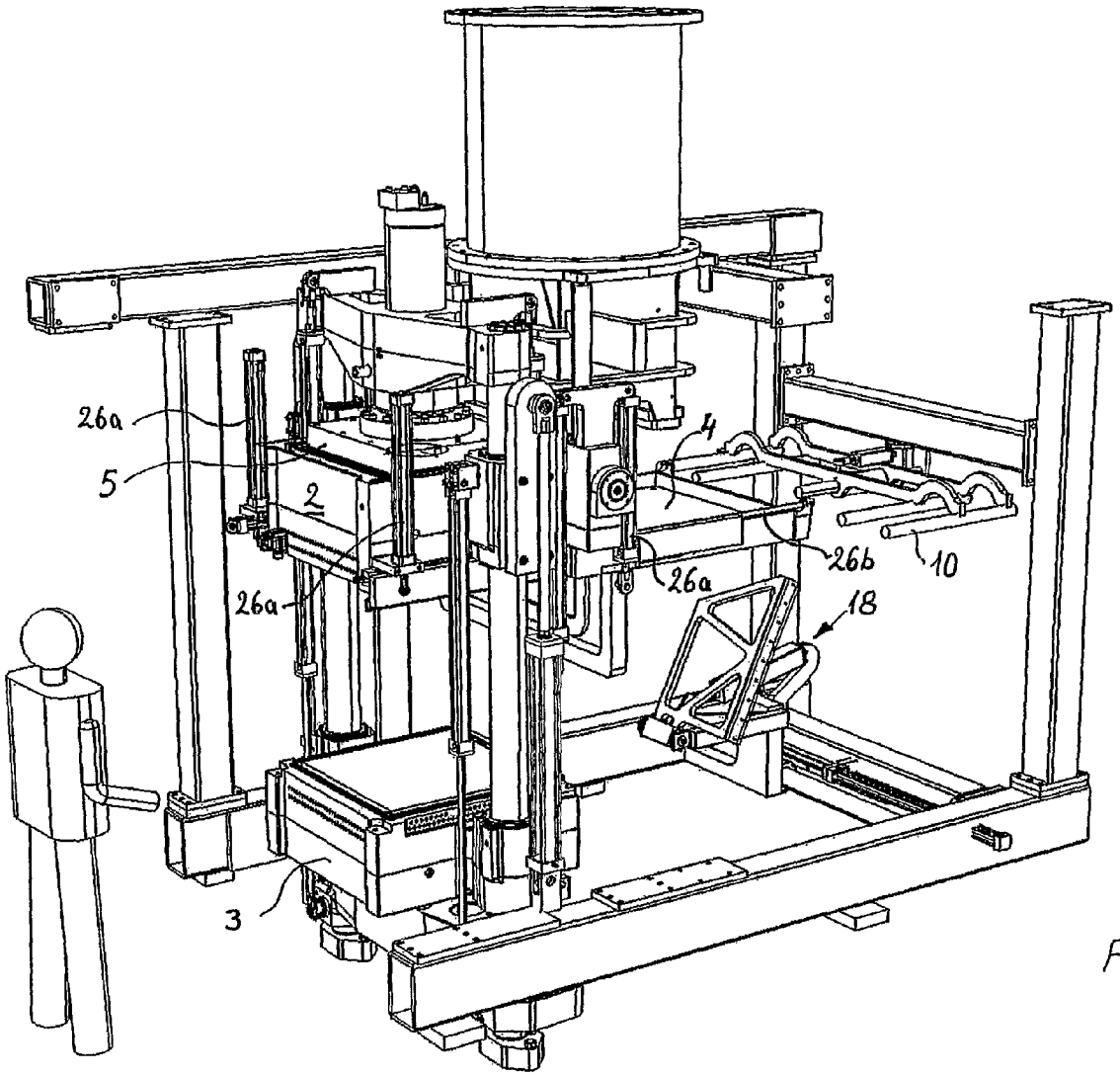
FIG. 7 shows the moulding machine with the pattern plate removed, and still in the open position to allow possible insertion of cores in the mould.
Figure 8:
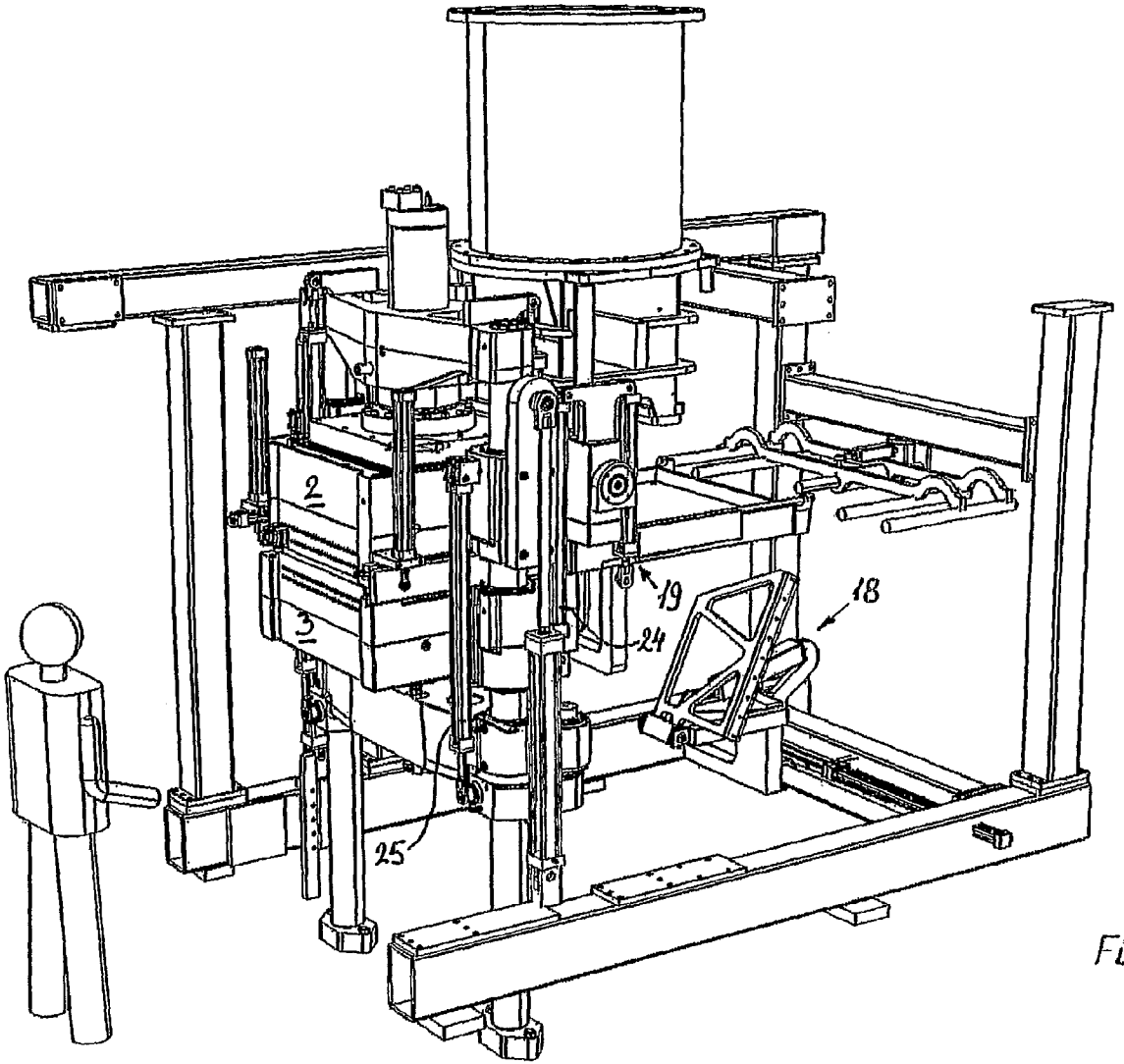
FIG. 8 shows the moulding machine in a position where the cope and drag flasks are brought into contact with one another ready for removing the finished mould parts.

After completion of the squeezing, the rotatable part of the machine is rotated over 90° back from the vertical position to its starting position, in which the cope flask 2 and the drag flask 3 take their horizontal position, essentially as shown in FIG. 4. In a next step, the drag flask 3 and the squeeze plate 6 are lowered in unison and the pattern plate 4 is lowered to take a position in between the cope flask 2 and the drag flask 3, as shown in FIG. 6, causing the pattern plate 4 to separate from the cope flask 2 by being lowered while resting on the drag flask 3 until the pattern-plate-moving mechanism 19 engages the pattern plate 4, causing the pattern plate 4 to separate from the drag flask 3. In the next step, the pattern plate 4 is retracted from the space between the cope flask 2 and the drag flask 3 by the hydraulic cylinder **26*b* and moved upwards by the hydraulic cylinder 26*a* to the position shown in FIG. 7. The drag flask 3 and the drag squeeze plate 6 are raised in unison until the upper surface of the drag flask 3 is in contact with the lower surface of the cope flask 2, causing the mould surface of the cope to be brought into contact with the mould surface of the drag. Thus, the cope and drag are superposed, as shown in FIG. 8**.

Figure 9:
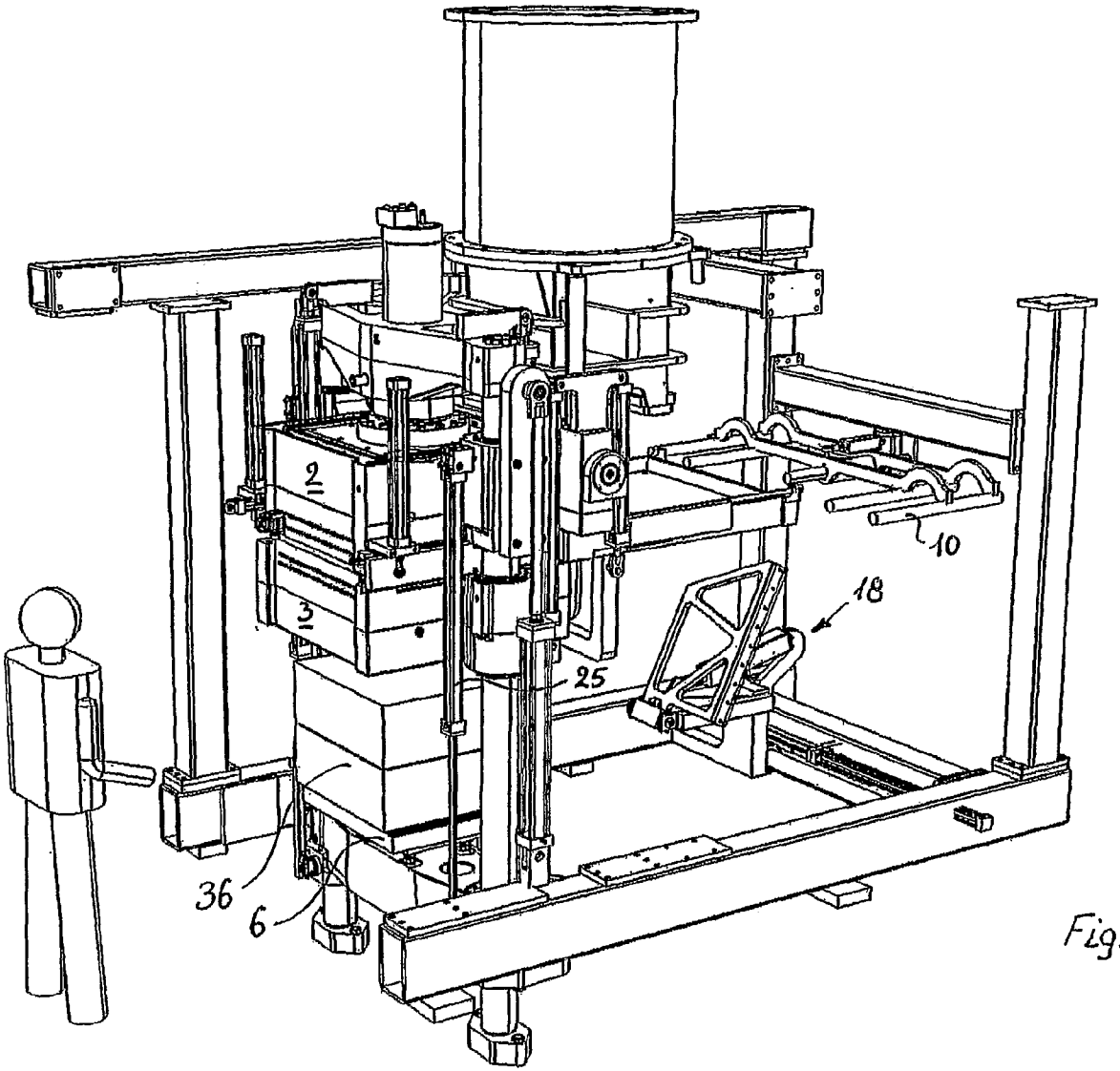
FIG. 9 shows the moulding machine in a position where the mould parts have been expelled from the cope flask and drag flask, resting on the drag squeeze plate.

Thereafter, the cope squeeze plate 5 is lowered by the piston cylinder unit 23 to separate the cope and drag from the cope flask 2 and drag flask 3. The drag squeeze plate 6 is simultaneously lowered by the piston cylinder unit 25, and the drag squeeze plate 6 serves as a table for the mould package 36 consisting of the superposed cope and drag moulds and moves the mould package 36 downwards to a position as shown in FIG. 9.

Figure 12:
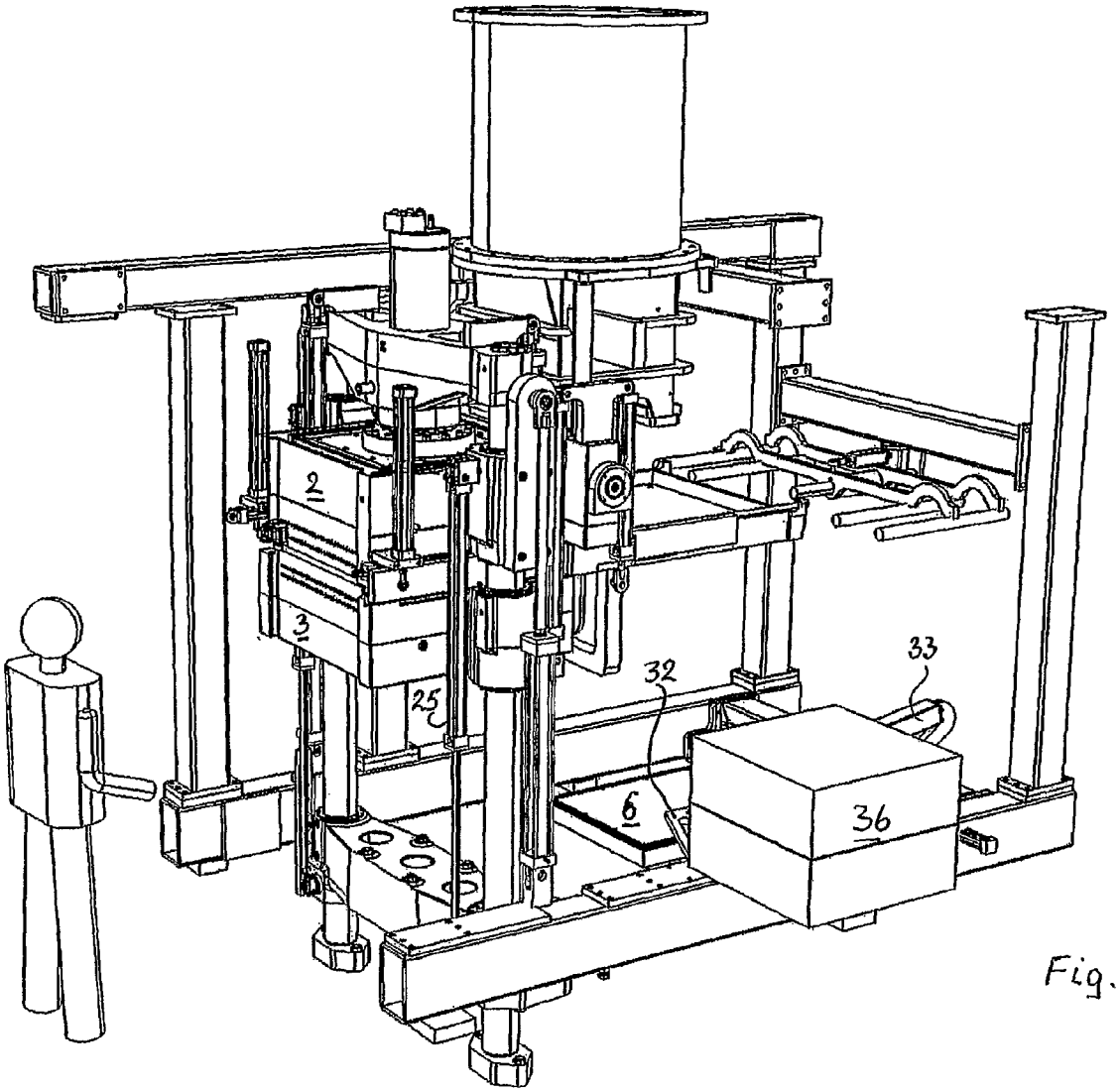
FIG. 12 shows the moulding machine with the finished mould parts expelled to the side of the machine.

Following this, an expelling arm 32 is tilted to the position shown in FIG. 10 by a piston cylinder unit 33, and the drag squeeze plate 6 is rotated to the position shown in FIG. 10, said rotation being provided by the piston cylinder unit 30 turning the drag squeeze plate about a bearing 31 associated with the drag squeeze plate 6. After this turning movement, the expelling arm 32 is turned back to the position shown in FIG. 11 by the piston cylinder unit 33, whereupon the piston cylinder unit 34 is activated to expel the mould package 36 to a position to the side of the mould-forming machine, as shown in FIG. 12, in which position the mould package 36 can be transported further on to a pouring unit on a separate transport system for this purpose.

Following this or at a later time before delivery of the next moulds, the expelling arm 32 is brought back to its starting position and the drag squeeze plate 6 is turned back into alignment with the drag flask 3, whereupon the drag flask 3 is lowered to allow insertion of the pattern plate 4 between the cope flask 2 and the drag flask 3, after which the drag flask 3, the drag squeeze plate 6 and the pattern plate 4 are brought to the position shown in FIG. 4 ready for a new cycle for the moulding machine.

The machine has now reached its starting position and is ready for producing the next mould as a part of a cycle operation, which is repeated for mass production of flaskless moulds.

Although the above described embodiment has been explained in detail, a man skilled in the art will be able to provide several deviations therefrom without departing from the scope of the following claims. Such deviations comprise e.g.

alternative positions of the bearings 12 to e.g. be associated with the drag flask 3, alternative position of the pressure cylinder 9 to e.g. be connected to the drag squeeze plate 6, use of other moving mechanisms than the described hydraulic cylinders for providing the relative movements of the different components, such as e.g. pneumatic cylinders or electric linear drives, etc.

LIST OF REFERENCE NUMERALS

1 Mould-forming machine for producing flaskless moulds
2 Cope flask
3 Drag flask
4 Pattern plate (match plate)
5 Cope squeeze plate
6 Drag squeeze plate
7 Guide rods
8 Yoke connecting the guide rods 7 and supporting the pressure cylinder 9
9 Pressure cylinder for compacting the sand moulds
10 Stays
11 Yokes on ends of guide rods 7 for engaging the stays 10
12 Bearing for rotational movement of the rotatable system
13 Piston cylinder unit for rotational movement
14 Connection for piston cylinder unit 13
15 Frame
16 Sand-charging system
17 Axis for rotational movement of rotatable system
18 Expelling mechanism
19 Pattern-plate-moving mechanism
20 Linear bearings for cope flask
21 Linear bearings for drag flask
22 Linear bearings for drag squeeze plate
23 Piston cylinder unit for relative movement of cope squeeze plate
24 Piston cylinder unit for relative movement of drag flask
25 Piston cylinder unit for relative movement of drag squeeze plate
26*a,b* Piston cylinder units for relative movement of pattern plate
27 Guide rods for pattern-plate-moving mechanism 19
28 Rails for pattern-plate-moving mechanism 19
29 Sand-charging openings
30 Piston cylinder unit for rotational movement of drag squeeze plate
31 Bearing for rotational movement of drag squeeze plate
32 Expelling arm
33 Piston cylinder unit for tilting expelling arm 32
34 Piston cylinder unit for moving expelling arm 32 to expel the produced superposed cope and drag
35 Yoke for drag squeeze plate 6
36 Mould package

The invention claimed is:

1. A molding machine for producing flaskless molds comprising:

a drag flask and a cope flask, a drag squeeze plate associated with said drag flask and a cope squeeze plate inserted in said cope flask, all arranged to be rotated between a horizontal and a vertical position and the drag flask and cope flask being arranged to be movable relative towards one another and away from one another, characterized in that the drag flask, the cope flask, the drag squeeze plate and the cope squeeze plate are guided in their relative movement by a single set of two guide rods.

2. Molding machine in accordance with claim 1, characterized in that the two guide rods are positioned in a symmetrical plane of the cope flask and the drag flask.

3. Moulding machine in accordance with claim 1, characterized by further comprising moving means for the relative positioning of the cope flask, drag flask, cope squeeze plate and drag squeeze plate, said moving means preferably being positioned symmetrically relative to the flasks and squeeze plates.

4. Molding machine in accordance with claim 1, characterized by comprising a bearing for the rotational movement, said bearing being associated with the cope flask.

5. Molding machine in accordance with claim 1, characterized by the guide rods being mounted floating relative to the cope flask, drag flask, drag squeeze plate and cope squeeze plate, and a pressure cylinder for compacting a sand mold being connected between the cope squeeze plate and a yoke mounted between the ends of the guide rods close to the cope squeeze plate.

6. Molding machine in accordance with claim 5, characterized by further comprising means for fixating the drag squeeze plate relative to the guide rods during compaction of the sand molds.

7. Molding machine in accordance with claim 6, characterized by said means for fixating the drag squeeze plate relative to the guide rods comprising stays, said stays during the compacting of the sand molds being positioned between the drag squeeze plate and yoke(s) mounted at the ends of the guide rods close to the drag squeeze plate.

8. Molding machine in accordance with claim 1, characterized by comprising a pattern-plate-moving mechanism mounted on the guide rod or on separate guide rods connected to the cope flask, said moving mechanism comprising piston cylinder units for moving the pattern plate in and out of the interspace between the cope flask and the drag flask and up and down, as seen in the horizontal position of the cope flask and drag flask, when in the inserted or in the retracted state.

9. Molding machine in accordance with claim 1, characterized by the drag squeeze plate being adapted to receive the finished mold and being mounted for a rotation about an axis parallel with the guide rods for expelling the finished mold sideways out of the molding machine in a suitable direction.

* * * * *